US009993858B2

(12) United States Patent
Kayhan et al.

(10) Patent No.: US 9,993,858 B2
(45) Date of Patent: Jun. 12, 2018

(54) ROLL FOR HOT ROLLING

(71) Applicant: SANDVIK INTELLECTUAL PROPERTY AB, Sandviken (SE)

(72) Inventors: Menderes Kayhan, Tumba (SE); Jan-Erik Karlsson, Tyreso (SE); Stephen Hewitt, Warwickshire (GB)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 613 days.

(21) Appl. No.: 14/345,443

(22) PCT Filed: Sep. 19, 2012

(86) PCT No.: PCT/EP2012/068429

§ 371 (c)(1),
(2) Date: Mar. 18, 2014

(87) PCT Pub. No.: WO2013/041559

PCT Pub. Date: Mar. 28, 2013

(65) Prior Publication Data

US 2015/0018185 A1 Jan. 15, 2015

(30) Foreign Application Priority Data

Sep. 19, 2011 (EP) ..... 11181778

(51) Int. Cl.
*B21B 27/02* (2006.01)
*B22F 3/15* (2006.01)
(Continued)

(52) U.S. Cl.
CPC ..... *B21B 27/02* (2013.01); *B21B 1/26* (2013.01); *B21B 27/032* (2013.01); *B22F 3/15* (2013.01);
(Continued)

(58) Field of Classification Search
CPC ..... B21B 27/02; B21B 1/26; B21B 27/032; B22F 3/15; B22F 3/24; C22C 38/30;
(Continued)

(56) References Cited

U.S. PATENT DOCUMENTS 4,469,514 A * 9/1984 Holtz, Jr. ..... B22F 1/0003 420/10
4,941,251 A * 7/1990 Sobue ..... B21B 27/03 492/3
6,095,957 A * 8/2000 Ichino ..... B21B 27/00 492/54

FOREIGN PATENT DOCUMENTS

CN 101078090 A 11/2007
EP 1249512 B1 9/2006
(Continued)

OTHER PUBLICATIONS

English Machine Translation of JP02194144A, Jul. 31, 1990.*
English Machine Translation of JP2009-138259, Jun. 25, 2009.*

*Primary Examiner* — Sarang Afzali
(74) *Attorney, Agent, or Firm* — Eric Shaffer

(57) ABSTRACT

A roll for hot-rolling includes a body, wherein at least a part of an envelope surface of the body is made of a high speed steel that with reference to its chemical composition consists of the following elements, in weight %: 1-3 Carbon (C), 3-6 Chromium (Cr), 4.5-7 Molybdenum (Mo), 6-15 Tungsten (W), 3-14 Vanadium (V), 0-10 Cobalt (Co), 0-3 Niobium (Nb), 0-0.5 Nitrogen (N), 0.4-1 Yttrium (Y), eventualy distributed in the powder, and remainder iron (Fe) and unavoidable impurities, wherein contents of molybdenum (Mo) and tungsten (W) satisfy the formula Mo+0.5W=2.0-10.0 weight %.

17 Claims, 2 Drawing Sheets

Figure 1:
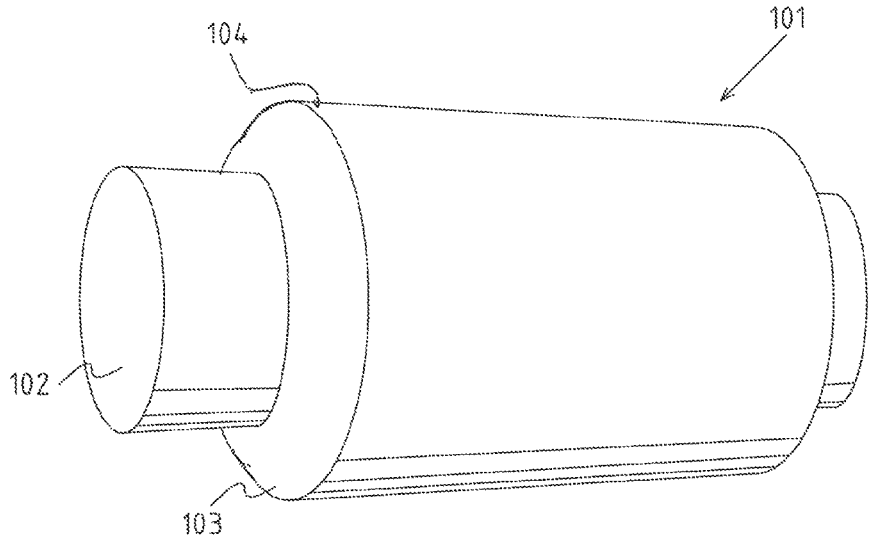

(51) Int. Cl.

| | |
|---|---|
| ***B21B 27/03*** | (2006.01) |
| ***B22F 3/24*** | (2006.01) |
| ***C22C 33/02*** | (2006.01) |
| ***C22C 38/22*** | (2006.01) |
| ***C22C 38/24*** | (2006.01) |
| ***C22C 38/26*** | (2006.01) |
| ***C22C 38/30*** | (2006.01) |
| ***B21B 1/26*** | (2006.01) |

(52) U.S. Cl.
CPC ..... *B22F 3/24* (2013.01); *C22C 33/0278* (2013.01); *C22C 38/22* (2013.01); *C22C 38/24* (2013.01); *C22C 38/26* (2013.01); *C22C 38/30* (2013.01); *Y10T 29/49544* (2015.01)

(58) Field of Classification Search
CPC ..... C22C 38/26; C22C 38/22; C22C 38/24; C22C 33/0278; C22C 38/18; Y10T 29/49544
See application file for complete search history.

(56) References Cited

FOREIGN PATENT DOCUMENTS

| | | | | | |
|---|---|---|---|---|---|
| JP | 57085952 | A | | 5/1982 | |
| JP | S61213348 | A | | 9/1986 | |
| JP | H1241306 | A | | 9/1989 | |
| JP | 2194144 | A | | 7/1990 | |
| JP | 2000254715 | A | | 9/2000 | |
| JP | 2002105580 | A | | 4/2002 | |
| JP | 2009138259 | A | * | 6/2009 | ..... B22F 1/00 |
| RU | 2164961 | C2 | | 4/2001 | |

* cited by examiner

PRIOR ART

ROLL FOR HOT ROLLING

RELATED APPLICATION DATA

This application is a § 371 National Stage Application of PCT International Application No. PCT/EP2012/068429 filed Sep. 19, 2012 claiming priority of EP Application No. 11181778.9, filed Sep. 19, 2011.

TECHNICAL FIELD

The present invention relates generally to the field of rolls for hot-rolling. Furthermore, the present invention relates specifically to the field of work rolls for hot-rolling.

BACKGROUND

Hot rolling of metal is a metal forming process that takes place at temperatures above the recrystallization temperature of the metal subjected to forming. This means that the rolling is performed at elevated temperatures, typically at temperatures above 700° C. Such high temperature during the rolling operation causes mechanical challenges for the equipment used in hot-rolling. The high temperature causes problems with hardness reduction of the roll material, therefore, the hot hardness of the roll is of utter importance in order to enable longer lifetime of the rolls.

In addition to the high temperature, the rolling sequence often comprises cooling of the rolled metal by subjecting the rolls to water, thereby causing large amounts of steam to be formed. The steam in combination with elevated temperatures causes severe oxidation of the rolling equipment used and especially the work rolls of the rolling equipment. The material used for the rolling rolls therefore needs to withstand high temperature without losing its hardness as well as a good abrasion/wear resistance at said temperatures and atmosphere.

Traditionally, the work rolls for hot rolling have been manufactured from high chromium nickel cast alloys. In most cases today work rolls for hot-rolling are composite rolls. The composite roll comprises a core with suitable mechanical properties, such as ductile iron or steel, and a sleeve with sufficient hot-hardness and sufficient wear resistance for the hot rolling.

The development of the outer layer of the roll have been very rapid since the beginning of the 1980's culminating in the applications of cast alloys containing Fe—C—Cr—W—Mo—V which replaced high chromium cast iron and Ni-hard cast iron. Alloys of this composition are generically called high speed steel.

The classical high speed steel exhibits both good hot-hardness and good wear resistance. In order to further improve the desired properties for hot rolling applications, the alloy design of the high speed steel is based on the composition of a so called M2 steel, wherein the main changes being higher carbon and vanadium content. A typical composition of such high speed steel often falls into the following ranges: 1.5-2.5% C, 0-6% W, 0-6% Mo, 3-8% Cr, and 4-10% V.

Basically, the essential target of a rolling mill plant is to keep the shape profile and surface roughness of the rolled metal as close as possible to the target values. The better performance of the high speed steel rolls in comparison to the previously used hot roll materials is related to the microstructural characteristics of the high speed steel such as a high amount of very hard and fine MC eutectic carbides and a base matrix hardened by secondary precipitated carbides.

Roll wear in hot-rolling is a complex process characterized by the concurrent operation of several surface degradation phenomena that involves at least: abrasion, oxidation, adhesion, and thermal fatigue. Thermal fatigue stems from stress developed by cyclic heating and cooling of a very thin boundary layer close to the roll surface. Adhesion comes from micro-welding regions of working metal into roll metal in the sticking zone of the roll gap. In the art, it is known that an increase of the volume fraction of eutectic carbides has a beneficial impact on the adhesive behaviour.

Oxidation of the roll during hot rolling markedly influences the wear behaviour of the roll material, since as long as this layer is smooth, adherent and continuous, it acts as a solid lubricant and as a thermal barrier, thus protecting the roll surface from degradation.

In U.S. Pat. No. 6,095,957, a roll for hot rolling with an outer layer comprising Fe—C—Mo—Nb—V is disclosed. This solution suggests that further improvement of the outer layer is possible.

In U.S. Pat. No. 4,941,251, a roll for hot rolling with an outer layer of ceramic is disclosed. However, this ceramic layer is brittle and hard to machine to the desired final dimensions of the working roll.

THE OBJECT OF THE INVENTION

The present invention aims at obviating the aforementioned disadvantages of previously known composite rolls for hot rolling, and also at providing an improved roll for hot-rolling. A primary object of the present invention is to provide an envelope surface for a roll for hot rolling with improved wear resistance at elevated temperatures, e.g. above 700° C.

SUMMARY

According to the present invention at least the primary object is attained by means of the initially defined roll for hot-rolling having the features defined in the independent claim. Preferred embodiments of the present invention are further defined in the dependent claims.

According to the present invention, there is provided a roll for hot-rolling of the initially defined type comprising a body, wherein the roll is characterised in that at least a part of an envelope surface of said body is made of a high speed steel that with reference to its chemical composition consists of the following elements, in weight %: 1-3 Carbon (C), 3-6 Chromium (Cr), 0-7 Molybdenum (Mo), 0-15 Tungsten (W), 3-14 Vanadium (V), 0-10 Cobalt (Co), 0-3 Niobium (Nb), 0-0.5 Nitrogen (N), 0.2-1 Yttrium (Y), and remainder iron (Fe) and unavoidable impurities, wherein Mo+0.5W = 2-10 weight %. This results in an envelope surface of said body that has excellent wear resistance at elevated temperatures.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "an embodiment" in various places throughout the specification is not necessarily referring to the same embodiment. Further, particular features, structures or characteristics may be combined in any suitable manner in one or more embodiments.

According to an embodiment, said sleeve is made of a consolidation of a powder of said high speed steel, which powder is subjected to elevated heat and elevated pressure causing said consolidation. The powder is preferably manufactured by atomization of molten metal comprising said elements into said powder. By using argon-atomisation of the molten metal the amount of nitrides is minimized compared to using nitrogen-atomisation wherein the use of nitrogen gas causes nitrides to form.

The technical effect of the aforementioned provision of powder is that the rare earth element yttrium is evenly distributed in the powder. If the high speed steel according to the invention would have been produced by a casting method, the highly reactive element yttrium would segregate and not be evenly distributed. An even distribution of yttrium in the high speed steel base-matrix causes an oxide scale that is formed to adhere effectively to the high speed steel. The added yttrium also changes the growth kinetics of the oxide scale so that the scale quickly grows to a saturation thickness; the growth rate of the oxide scale is drastically reduced above this saturation thickness. The beneficial technical effect on the wear resistance at elevated temperatures, due to the fine dispersion of yttrium in the base-matrix of the high speed steel is unexpectedly good. This technical effect is beyond what a person skilled in the art would expect from an addition of yttrium using a powder metallurgy method.

According to the present invention, the carbon (C) content of said high speed steel is in the range of from 1-3 weight %. The amount of carbon should be sufficient to form the carbides necessary for the wear resistance of the high speed steel. Preferably the amount of carbon should be enough to produce a high speed steel with sufficient hardenability. The higher limit of 3% defines maximum carbon content; above that limit retained austenite may be formed. According to an embodiment, the carbon content is in the range of from 1.1-1.4 weight %.

According to the present invention, the chromium (Cr) content is in the range of 3-6 weight %. This interval causes good hardenability as well as the necessary formation of carbides. However, too much chromium causes residual austenite and increased risk for over-tempering, therefore the upper limit of 6% should not be exceeded. According to an embodiment, the Cr content is in the range of from 4.0-5.0 weight %.

According to the present invention, the molybdenum (Mo) content is in the range of 0-7 weight %. Addition of molybdenum causes secondary hardening by precipitation of carbides that will increase the hot hardness and wear resistance of the high speed steel. According to one embodiment, the Mo content is in the range of from 4.5-5.5 weight %.

According to the present invention, the tungsten (W) content is in the range of from 0-15 weight %. Addition of tungsten causes secondary hardening by precipitation of carbides that will increase the hot hardness and wear resistance of the high speed steel. According to an embodiment, the W content is in the range of from 6.0-7.0 weight %.

According to the present invention, the vanadium (V) content is in the range of from 3-14 weight %. Addition of vanadium causes secondary hardening by precipitation of carbides that will increase the hot hardness and wear resistance of the high speed steel. However, too much vanadium causes the high speed steel to become brittle and therefore, the upper limit of 14% should not be exceeded. According to an embodiment, the V content is in the range of from 3.0-5.0 weight %, preferably in the range of from 3.0-3.5 weight %.

According to the present invention, the cobalt (Co) content of said high speed steel is in the range of from 0-10 weight %. Alloying a high speed steel with cobalt improves the tempering resistance and hot hardness, as both are utterly important for a high speed steel to be used in a high temperature wear application. The amount of cobalt also has an effect on the hardness of the high speed steel by affecting the amount of retained austenite, causing said retained austenite to be easily converted to martensite during tempering. The selected interval for cobalt is a suitable interval for a high speed steel of this composition wherein the upper level is more an economic compromise than a scientific constraint. According to one embodiment of the invention, the Co content is 0% or at an impurity level, while according to an alternative embodiment, it is in the range from of 8.0-9.0 weight %.

According to the present invention, the high speed steel should contain yttrium in the interval 0.2% to 1%, such as from 0.4 to 0.7 weight %, preferably in the range from of 0.45-0.60 weight %, from such as from 0.4-0.5 weight %, such as 0.4, 0.41, 0.42, 0.43, 0.44, 0.45, 0.46, 0.47, 0.48, and 0.50 weight %. The yttrium content defined in the interval above gives the aforementioned positive effects on the oxide scale. Especially the yttrium content in the range of from 0.45-0.60 weight % gives a very good increase in the ability of the high speed steel to withstand high temperature wear. The lower limit 0.2% of the interval defines a starting point from where a significant positive effect of yttrium on the high temperature wear can be identified, the higher limit of 1% indicates the end of the interval from where a significant positive effect of yttrium on the high temperature wear can be identified.

According to an embodiment, said body comprises an axially extending core, and an axially extending sleeve arranged radially outside said core. Thereby, the core can be constructed to provide excellent heat transfer and mechanical robustness, the sleeve on the other hand can be arranged to provide excellent wear resistance.

According to an embodiment, said sleeve is made of said high speed steel. This causes the wear resistance of said sleeve to exhibit excellent properties for hot rolling, such as wear resistance and hot hardness.

According to an embodiment, the powder of which the sleeve is formed, is subjected to elevated heat (e.g. 1150° C.) and elevated pressure (e.g. 1000 bar) for a long period (e.g. 2 hours), such that a consolidation of the powder is achieved.

According to an embodiment, the sleeve of consolidated powder is then subjected to a soft annealing step at 900° C. followed by a temperature decrease to 700° C. at a cooling rate of 10° C./hour, from thereon the sleeve is allowed to naturally cool down to room temperature. This soft annealing step causes the carbides in the high speed steel to spheroidize.

The sleeve is thereafter preferably subjected to machining and thereafter heat treated with a hardening (austenizing) step at 1100° C. and three subsequent annealing steps at 560° C. for 60 minutes each, with natural cooling to room temperature there between.

According to one embodiment, said core is made of cast steel or forged steel. A core made of cast steel or cast iron or forged steel is easy to machine and heat treat to the desired functionality. Such a core is also cost effective and easy to produce.

According to the present invention, the microstructure of the sleeve is isotropic. As a result thereof, the wear properties of the sleeve material are improved.

According to the invention, it is preferred that the material of said sleeve contains carbide particles that have a mean carbide particle size which is <3 μm.

According to a preferred embodiment said sleeve is shrink fitted onto said core. By utilizing shrink fitting of said sleeve onto said core, the sleeve can easily be removed and exchanged, thereby causing a significant cost reduction.

BRIEF DESCRIPTIONS OF THE DRAWINGS

Figure 2:
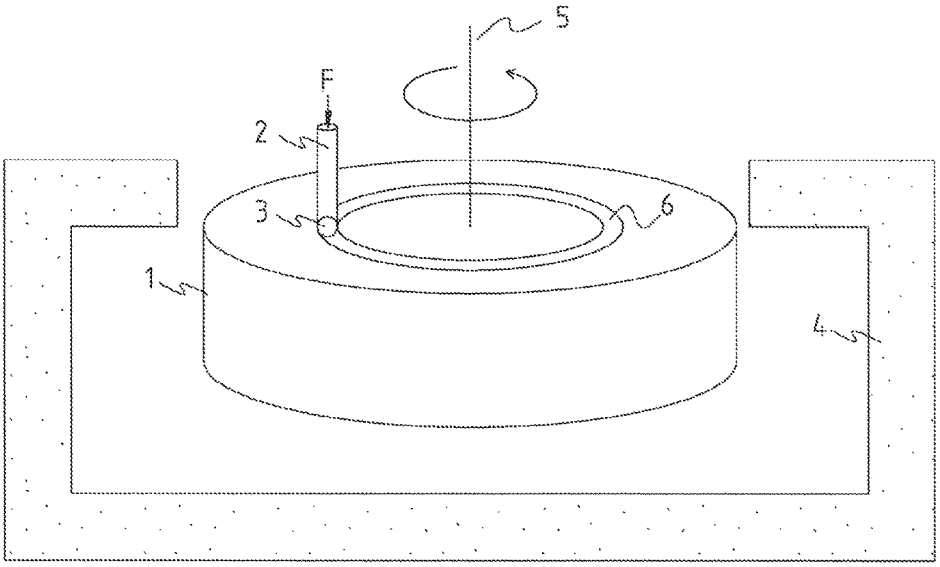
PRIOR ART Figure 2
Figure 3:
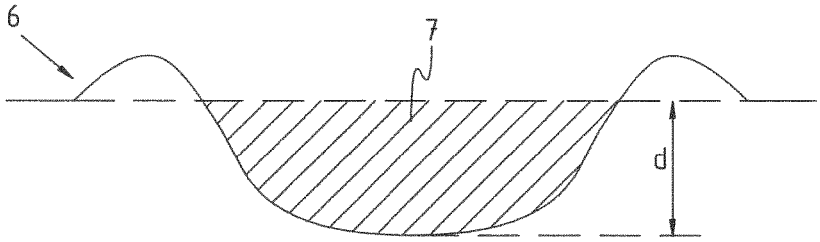
Figure 4:
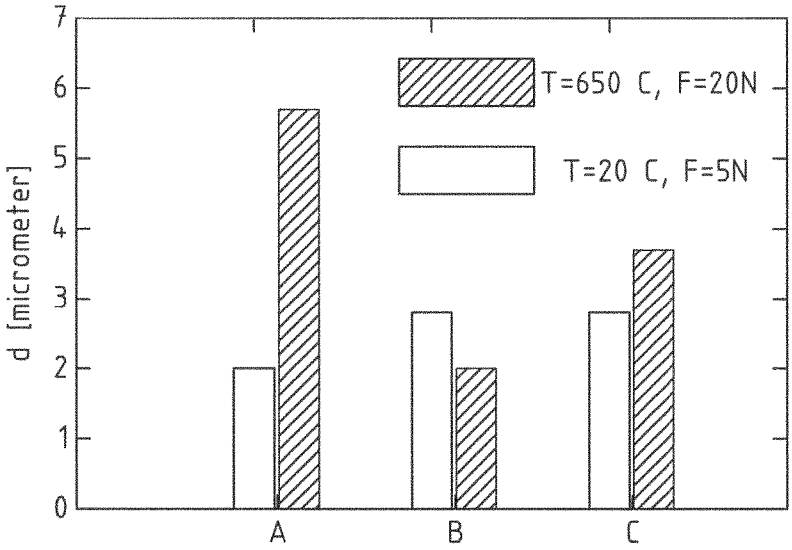
Figure 5:
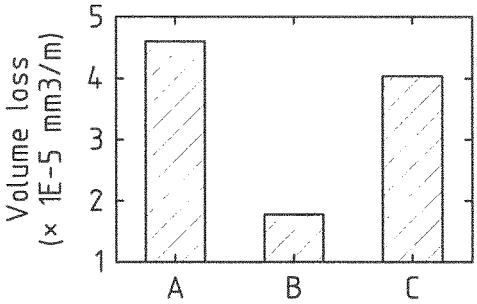
Figure 6:
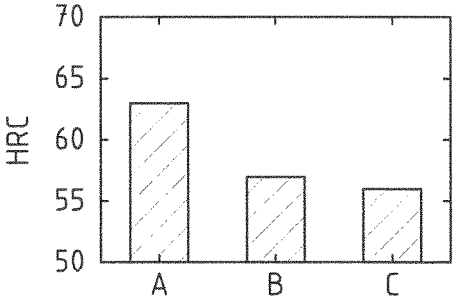

The inventive concept will now be further explained using reference figures in connection with attached drawings and graphs, in which FIG. 1 is a perspective view of a compound roll, FIG. 2 is a schematic figure of a "pin on disc" test equipment, FIG. 3 shows a cross section of a typical groove obtained from a "pin on disc" evaluation, perpendicular to the longitudinal direction, FIG. 4 is a diagram showing the groove depth at room temperature and 650° C. for the alloys A, B and C in the "pin on disc" experiment, FIG. 5 is a diagram showing the volume loss per meter at 650° C. for the alloys A, B and C in the "pin on disc" experiment, and FIG. 6 shows the hardness in HRC for alloy A, B and C.

DETAILED DESCRIPTION

The industrial production of semi-finished products, components and cutting tools based on powder metallurgical high speed steel started 35 years ago. The first powder metallurgical production of high speed steel was based on hot isostatic pressing (HIP) and consolidation of atomized powders. The HIP step was normally followed by hot forging of the HIP'ed billets. This method of production is still the dominating powder metallurgical method to produce high speed steel.

The original objective for research and development on powder metallurgical processing of high speed steel was to improve the functional properties and performance of high speed steel in demanding applications. The main advantages from the powder metallurgical manufacturing process are no segregation with a uniform and isotropic microstructure. The well known problems with coarse and severe carbide segregation in conventional cast steel and forged steel are thus avoided in powder metallurgical high speed steel.

Thus, the powder metallurgical manufacturing method of a high speed steel with sufficient amount of carbon and carbide forming elements results in a dispersed distribution of carbides that to a large extent solves the problem of low strength and toughness associated with conventionally produced high speed steel.

FIG. 1 shows a composite roll 101 for hot-rolling. The roll 101 comprises an axially extending core 102 with an envelope surface 104 formed by an axially extending sleeve 103 arranged radially outside said core 102.

The core 102 is manufactured of a material with good mechanical properties and good heat conductive properties, examples of such materials are ductile iron or steel. The core 102 is a cylindrical journal that comprises at a first end and at a second end means for support bearings. The support bearings allow the working roll to be mounted in the hot rolling mill. Between said first end and said second end is provided a longitudinal region arranged for shrink fitting of the sleeve 103 onto said core 102.

The sleeve 103 is a cylindrical sleeve with an inner diameter that is dimensioned for shrink fitting the sleeve 103 onto said core 102. The wall thickness of the sleeve 103 is dimensioned with respect to heat transfer and work roll lifetime as well as geometrical constraints. In a preferred embodiment of the invention the thickness of the sleeve is 40 millimetres.

According to the present invention, the sleeve 103 is made of a high speed steel that with reference to its chemical composition consists of the following elements: 1-3 wt-% Carbon (C), 3-6 wt-% Chromium (Cr), 0-7 wt-% Molybdenum (Mo), 0-15 wt-% Tungsten (W), 3-14 wt-% Vanadium (V), 0-10 wt-% Cobalt (Co), 0-3 wt-% Niobium (Nb), 0-0.5 wt-% Nitrogen (N), 0.2-1 wt-% Yttrium (Y), and remainder iron (Fe) and unavoidable impurities. It should be pointed out that the elements having a lower limit of 0% are optional and can thus be omitted. The manufacturing of the sleeve 103 comprises of a powder of said high speed steel to form a body from said powder. This forming may for example comprise pouring said powder into a capsule in the form of the sleeve 103; the capsule is then evacuated and sealed. In order to consolidate the powder, the capsule is subjected to heat and pressure in a so called hot isostatic processing (HIP) step.

In an embodiment of the invention, the provision of the powder mixture comprises the step of argon gas-atomisation of molten metal comprising said elements into said powder. In an embodiment of the invention, the argon gas-atomisation of the molten high speed steel causes high speed steel particles of a maximum size of 160 μm to be formed.

After the provision of the powder, the sleeve is formed from said powder. This forming may for example comprise pouring said powder into a capsule; the capsule is then evacuated, e.g. by being subjected to a pressure of below 0.004 mbar for 24 hours in order to evacuate said capsule. The capsule is then sealed in order to maintain said pressure in the capsule. The consolidation of the powder is achieved by subjecting the capsule to an elevated temperature, e.g. about 1150° C., and an elevated pressure, e.g. about 1000 bar, for a long period of time, e.g. two hours. This last consolidation step is called hot isostatic pressing, HIP.

A soft annealing step follows the HIP step, preferably the soft annealing step is performed at 900° C. followed by a temperature decrease to 700° C. at a cooling rate of 10° C./hour, from thereon the sleeve is allowed to naturally cool down to room temperature.

After soft annealing the sleeve may be subjected to machining and preferably a hardening (austenizing) step at 1100° C. and three subsequent annealing steps at 560° C. for 60 minutes each, with natural cooling to room temperature there between.

The resulting sleeve from these subsequent steps exhibits a very good uniformity without the aforementioned segregations and coarse carbide structure, and the most important effect is that the yttrium element is evenly distributed in the base-matrix of the high speed steel.

TABLE 1

| Alloy | Carbon (C) wt-% | Chromium (Cr) wt-% | Molybdenum (Mo) wt-% | Vanadium (V) wt-% | Tungsten (W) wt-% | Yttrium (Y) wt-% |
|---|---|---|---|---|---|---|
| A | 1.28 | 4.2 | 5 | 3.1 | 6.4 | 0.0 |
| B | 1.18 | 4.2 | 5 | 3.1 | 6.4 | 0.5 |
| C | 1.19 | 4.2 | 5 | 3.1 | 6.4 | 1 |

TABLE 1-continued

| Alloy | Carbon (C) wt-% | Chromium (Cr) wt-% | Molybdenum (Mo) wt-% | Vanadium (V) wt-% | Tungsten (W) wt-% | Yttrium (Y) wt-% |
|---|---|---|---|---|---|---|
| D | 1.55 | 4 | 0.0 | 3.5 | 12 | 0.5 |
| E | 1.05 | 4 | 4.5 | 3.5 | 0.0 | 0.5 |

In order to demonstrate the superior properties of the material of the sleeve 103, a high speed steel was designed without the optional elements, see table 1. The exclusion of the optional elements causes a clear and concise demonstration of the improved high-temperature wear due to the method. A simple evaluation method "pin-on-disc" for high-temperature wear is described below.

Table 1 shows the elements of the high speed steel used in the experiment. Smelts were produced with the elements in table 1, and from these smelts, powders were produced be means of gas atomization using argon. The powders of alloy B and C in table 1 have a particle size of <160 μm, the powder of alloy A has a particle size of <500 μm.

In the following description, in order to further illustrate the present invention, a performed non-limiting experiment will be described in detail.

The preparation of samples began with filling of the capsules with powder, with said capsules made from spiral welded tubes with a diameter of 73 mm. The capsules were then exposed to a pressure below 0.004 mbar for 24 hours. The capsules were then sealed in order to maintain said pressure.

In order to consolidate the powder in the capsules a hot isostatic pressing operation was performed at 1150° C. and 1000 bar for 2 hours. The samples were then subjected to a soft annealing step at 900° C. followed by a temperature decrease to 700° C. at a cooling rate of 10° C./hour, from thereon the samples were allowed to naturally cool down to room temperature.

The samples were then machined and heat treated with a hardening (austenizing) step at 1100° C. and three subsequent annealing steps at 560° C. for 60 minutes each, with natural cooling to room temperature there between.

The final preparation step comprised of stepwise grinding and polishing of the samples in an automatic grinder/polisher. During the final polishing step a 1 μm diamond suspension was used.

FIG. 2 shows a simplified test set-up used for the tribological testing; this set-up is in the art called "pin on disc". The principle for the "pin on disc" tribological testing is as follows; a sample 1 is rotated around an axis 5 with a speed ω for a number of revolutions. Simultaneously with the rotation of the sample 1, a force F is applied to a pin 2 that in turn applies the same force F to a ball 3. The ball 3 is made of $Al_2O_3$ and has a diameter of 6 mm. The rotation of the sample 1 and the force F on the ball 3 causes a groove 6 to be formed in the sample 1.

In order to evaluate the wear behaviour at elevated temperatures the lower part of the "pin on disc" set-up is accommodated in a furnace 4. Thus, the furnace 4 can heat the sample 1, the ball 3 and the lower part of the pin 2 to the desired operating temperature.

FIG. 3 shows a cross section of the groove 6 perpendicular to the longitudinal direction of the groove 6. The depth d measured from the polished surface of the sample to the bottom of the groove 6 is used as a measure of the wear resistance of the sample. Another figure of the wear resistance is the cross-sectional area 7, which is defined as the cross-sectional area of the groove 6 below the polished surface of the sample 1 perpendicular to the longitudinal direction of the groove 6. The profile and depth d of the groove 6 was estimated using a Veeco Wyko NT9100 white light interferometer.

A series of samples according to the description above were produced and tested according to the "pin on disc" procedure outlined above. The "pin on disc" result is presented in FIG. 3. The linear speed in this test was 20 cm/s, the applied force F was 5N and 20N, respectively, and the samples were rotated 20000 revolutions.

As can be seen in FIG. 4, the addition of yttrium caused the depth of the groove to decrease at 650° C.; see alloy A with a groove depth d equal to 5.7 μm, alloy B with a groove depth d equal to 1.9 μm and alloy C with a groove depth d equal to 3.7 μm. This indicates the anticipated increased wear resistance at elevated temperatures for alloys produced by the inventive method. The addition of 0.5% yttrium to the high speed steel (Alloy B) caused a reduction of the groove depth d of roughly three times compared to the high speed steel without yttrium (Alloy A). Also the addition of 1% yttrium to the high speed steel (Alloy C) caused a reduction of the groove depth d at 650° C.

A more representative measure of the wear resistance is the volume loss per meter ($mm^3/m$). The calculation of the volume loss per meter is performed by integrating the cross sectional area 7 over the longitudinal direction of the track and divide by the circumference of the groove. In FIG. 5, the volume loss per meter is presented; volume loss for alloy A is $4.6\times10^{-5}$ $mm^3/m$, volume loss for alloy B is $1.8\times10^{-5}$ $mm^3/m$ and finally the volume loss for alloy C is $4\times10^{-5}$ $mm^3/m$. The relationship between the yttrium content of the high speed steel and the volume loss per meter thereof is illustrated in FIG. 5. From FIG. 5 one can conclude that the yttrium content of 0.5% clearly results in the lowest volume loss per meter. A higher yttrium content than 1% also has a beneficial effect on the volume loss per meter. This relationship implies that the yttrium content of 0.5% gives a superior increase in the implied wear resistance of the high speed steel. It should be noted that examples D and E, though not represented in the figures, also show corresponding positive effects due to the addition of yttrium thereto.

According to the invention, the yttrium content of the high speed steel is within the range 0.2 to 1 weight %. It is preferred that the yttrium content of the high speed steel is more than 0.4 weight %, and less than 0.7 weight, more preferably 0.4 to 0.6 weight %, such as 0.4 to 0.5 weight %, such as 0.4, 0.41, 0.42, 0.43, 0.44, 0.45, 0.46, 0.47, 0.48, 0.49 and 0.5.

In FIG. 6, the hardness of the samples is presented. The hardness is 63 HRC for alloy A, the hardness is 57 HRC for alloy B and the hardness is 56 HRC for alloy C. The conclusion from FIG. 6 is that the hardness is reduced with the addition of yttrium. Without wishing to be bound to any specific theory, one possible explanation for this reduction is that less carbon is available in the alloys that contain yttrium, thereby reducing the hardness. This illustrates the theory that the wear rate of the high speed steel, in FIG. 4, at room temperature is primarily dominated by the hardness of the high speed steel. At room temperature the wear rate increases with decreasing hardness. However, at elevated temperatures, other mechanisms are dominating the wear, such as the growth kinetics and the mechanical properties of the oxide scale.

The invention claimed is:

1. A roll for hot-rolling comprising a body, wherein at least a part of an envelope surface of said body is made of a high speed steel by consolidation of a powder that with reference to its chemical composition consists of the following elements, in weight %:

1.0-3.0 Carbon (C);
3.0-6.0 Chromium (Cr);
4.5-7.0 Molybdenum (Mo);
6.0-15.0 Tungsten (W);
3.0-14.0 Vanadium (V);
0-10.0 Cobalt (Co);
0-3.0 Niobium (Nb);
0-0.5 Nitrogen (N);
0.4-1.0 Yttrium (Y), evenly distributed in the powder; and
remainder iron (Fe) and unavoidable impurities, wherein contents of molybdenum (Mo) and tungsten (W) satisfy the formula Mo+0.5W=2.0-10.0 weight %,
wherein the Yttrium (Y) evenly distributed in the powder comprises an oxide scale adhering to the high speed steel.

2. A roll for hot-rolling according to claim 1, wherein said body includes an axially extending core, and an axially extending sleeve arranged radially outside said core.

3. A roll for hot-rolling according to claim 2, wherein said sleeve is made of said high speed steel.

4. A roll for hot-rolling according to claim 2, wherein said sleeve is made of a consolidation of a powder of said high speed steel, which powder is subjected to elevated heat and elevated pressure causing consolidation.

5. A roll for hot-rolling according to claim 2, wherein said core is made of cast steel or cast iron or forged steel.

6. A roll for hot-rolling according to claims 2, wherein a material of said sleeve has carbide particles that have a mean carbide particle size<3.0 μm.

7. A roll for hot-rolling according to claim 2, wherein the sleeve has an isotropic microstructure.

8. A roll for hot-rolling according to claim 2, wherein said sleeve is shrink fit on said core.

9. A roll for hot-rolling according to claim 1, wherein the yttrium (Y) content of said high speed steel is less than 0.6 weight %.

10. A roll for hot-rolling according to claim 1, wherein the yttrium (Y) content of said high speed steel is in the range 0.45-0.60 weight %.

11. A roll for hot-rolling according to claim 1, wherein contents of moludbenum (Mo) and tungsten (W) are based on weight % and satisfy formula Mo+0.5W=5.0-8.5 weight %.

12. A roll for hot-rolling according to claim 1, wherein the carbon (C) content of said high speed steel is in the range of from 1.1-1.4 weight %.

13. A roll for hot-rolling according to claim 1, wherein the chromium (Cr) content of said high speed steel is in the range of from 4.0-5.0 weight %.

14. A roll for hot-rolling according to claim 1, wherein the Molybdenum (Mo) content of said high speed steel is in the range of from 4.5-5.5 weight %.

15. A roll for hot-rolling according to claim 1, wherein the tungsten (W) content of said high speed steel is in the range of from 6.0-7.0 weight %.

16. A roll for hot-rolling according to claim 1, wherein the Vanadium (V) content of said high speed steel is in the range of from 3.0-5.0 weight %.

17. The roll for hot-rolling according to claim 1, wherein the oxide scale adhering to the high speed steel is at a saturation thickness.

* * * * *